US011951537B2

(12) United States Patent
Conte et al.

(10) Patent No.: US 11,951,537 B2
(45) Date of Patent: Apr. 9, 2024

(54) METHOD TO CONTROL A SECONDARY COOLING APPARATUS IN A MACHINE FOR CONTINUOUS CASTING OF METAL PRODUCTS AND SECONDARY COOLING APPARATUS FOR A CONTINUOUS CASTING MACHINE

(71) Applicant: Danieli & C. Officine Meccaniche S.p.A., Buttrio (IT)

(72) Inventors: Riccardo Conte, Ronchi Dei Legionari (IT); Andrea Carboni, Milan (IT); Gianfranco Marconi, Udine (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 0 days.

(21) Appl. No.: 17/924,265

(22) PCT Filed: May 12, 2021

(86) PCT No.: PCT/IT2021/050140
§ 371 (c)(1),
(2) Date: Nov. 9, 2022

(87) PCT Pub. No.: WO2021/229620
PCT Pub. Date: Nov. 18, 2021

(65) Prior Publication Data

US 2023/0182197 A1 Jun. 15, 2023

(30) Foreign Application Priority Data

May 13, 2020 (IT) ..... 102020000010903

(51) Int. Cl.
*B22D 11/22* (2006.01)
*B22D 11/124* (2006.01)

(52) U.S. Cl.
CPC ..... *B22D 11/225* (2013.01); *B22D 11/1246* (2013.01)

(58) Field of Classification Search
CPC ... B22D 11/124; B22D 11/1246; B22D 11/22; B22D 11/225
USPC ..... 164/414, 455, 444, 486
See application file for complete search history.

(56) References Cited

U.S. PATENT DOCUMENTS 4,424,855 A * 1/1984 Tsubakihara et al. ..... B22D 11/1246 164/455
4,699,202 A * 10/1987 Gilles ..... B22D 11/225 164/455
2019/0054520 A1 2/2019 Foshag et al.

FOREIGN PATENT DOCUMENTS

WO 2017042059 A1 3/2017
WO 2018224304 A1 12/2018

OTHER PUBLICATIONS

International Search Report and Written Opinion dated Sep. 10, 2021 in PCT/IT2021/050140.

* cited by examiner

*Primary Examiner* — Kevin P Kerns
(74) *Attorney, Agent, or Firm* — Panitch Schwarze Belisario & Nadel LLP

(57) ABSTRACT

A method to control a secondary cooling apparatus in a machine for continuous casting of metal products is provided. The secondary cooling apparatus includes a plurality of cooling units equipped with nozzles, each nozzle is provided with delivery orifices from which a refrigerant fluid is delivered, on each occasion according to the punctual cooling needs, toward a metal product.

20 Claims, 4 Drawing Sheets

METHOD TO CONTROL A SECONDARY COOLING APPARATUS IN A MACHINE FOR CONTINUOUS CASTING OF METAL PRODUCTS AND SECONDARY COOLING APPARATUS FOR A CONTINUOUS CASTING MACHINE

CROSS-REFERENCE TO RELATED APPLICATIONS

This application is a Section 371 of International Application No PCT/IT2021/050140, filed May 12, 2021, which was published in the English language on Nov. 18, 2021, under International Publication No. WO 2021/229620 A1, which claims priority under 35 U.S.C. § 119(b) to Italian Application No. 102020000010903, filed May 13, 2020, the disclosures of each of which are incorporated herein by reference.

FIELD OF THE INVENTION

The present invention concerns a method to control a secondary cooling apparatus in a machine for continuous casting of metal products.

In particular, the secondary cooling apparatus acts on the metal products at the exit from the mold and along the roller path located downstream thereof. By way of example only, the cast metal products can be blooms, billets, slabs or other known types.

BACKGROUND OF THE INVENTION

It is known that a metal product, during the continuous casting, passes from a liquid state to a partly solid state, arriving at a completely solid state in a predetermined position downstream of the casting itself. During these steps the skin of the metal product, which contains a liquid metal core inside it, gradually thickens until it solidifies completely.

The controlled removal of heat from the cast metal product initially occurs through heat exchange by means of a primary cooling apparatus. The primary cooling apparatus comprises a plurality of cooling channels associated or integrated with the containing walls of the mold (crystallizer).

Downstream of the crystallizer there is then provided a secondary cooling apparatus which comprises a plurality of nozzles, interspersed with rollers for supporting and guiding the metal product, and a circuit for feeding one or more cooling fluids to the nozzles as above.

The heat exchange mechanisms that intervene in the secondary cooling apparatus are irradiation and convection.

Irradiation is a heat exchange mechanism that occurs between two surfaces at different temperatures, for example between the surface of the metal product and the surfaces of the rollers for supporting and guiding the latter.

Convection, which in these types of applications occurs in a forced manner, is determined by the delivery, on the metal product to be cooled, of one or more cooling fluids, possibly also a mixture thereof.

The nozzles are normally disposed between the support and guide rollers so as to direct the one or more cooling fluids directly onto the metal product. For this purpose, the cooling devices can be disposed distanced from each other to cover, possibly overlapping, the entire transverse size of the cast metal product. Furthermore, the nozzles can deliver jets of cooling fluid that have different shapes, depending on the type of metal product to be cooled.

Conventionally, in continuous casting machines, the nozzles can be of the type that use only water, or of the type that use water and air.

In the case of nozzles that only deliver water, the latter is conveyed through a single orifice, or in cooperation with others, and sprayed onto the cast product. In order to adjust the cooling, in this case, the water flow rate of the nozzle is varied so that a determinate convective heat exchange effect is achieved. For the nozzles that only deliver water, there is a minimum feed pressure below which the flow becomes unstable. The maximum feed pressure is generally the highest one available in the hydraulic feed circuit. The ratio between the maximum water flow rate and the minimum water flow rate defines a parameter called Turn Down ratio in the sector, more briefly, hereafter, TD ratio. One disadvantage of this type of nozzles, and of the method to control them, is that it is not possible to increase the TD ratio since the minimum and maximum water flow rates are univocally determined and cannot be changed.

In the case of nozzles that deliver water and air, the addition of air has the function of expanding the adjustment range of the nozzle, allowing to adjust the water flow rate within a wider range, that is, to increase the TD ratio. However, it should be noted that as the air pressure increases, the water flow rate of the nozzle decreases.

Some examples of nozzles that only deliver water, and of the corresponding control methods, are described in patent documents WO 2017/042059 A1, WO 2018/224304 A1, and US2019/0054520 A1.

Patent documents WO 2017/042059 A1, WO 2018/224304 A1 respectively describe a method to control nozzles for the secondary cooling of a cast product and a nozzle equipped with a selectively activatable/deactivatable valve that allows the nozzle to deliver an intermittent flow, that is, pulsed. Thanks to the use of the valve, it is possible to carry out a work cycle and, working at equal pressure, decrease the flow rate of the nozzle without needing to add a flow of compressed air. However, with this type of nozzle, and with the method to manage it, it is not possible to obtain a uniform cooling of the cast product. In addition, the intermittent delivery has to be very well calibrated according to both the characteristics of the metal product exiting the mold and also the position where the specific nozzle operates.

Patent document US2019/0054520 A1 (US '520) describes cooling devices provided with multi nozzle heads fed by valves that allow the modulation of continuous jets of water only. In addition, US '520 A1 describes a method to manage the cooling devices based on the request for different flow rates to feed the nozzles. The management method, however, does not allow to optimize, that is, to reduce to a minimum, the overall energy consumption of the secondary cooling apparatus. In fact, as the flow rate increases, the feed pressure of the nozzles also increases and with it the pressure drops directly correlated to the power required from the water feed pump.

There this therefore the need to perfect a method to control a secondary cooling apparatus in a machine for the continuous casting of metal products that can overcome at least one of the disadvantages of the state of the art.

In particular, one purpose of the present invention is to perfect a method to control a secondary cooling apparatus in a machine for the continuous casting of metal products which allows to increase the adjustment range of the nozzles, allowing to adjust the water flow rate within a wider range, in other words to increase the TD ratio.

Another purpose of the present invention is to perfect a method to control a secondary cooling apparatus in a machine for the continuous casting of metal products which allows to control the energy consumption for each value of water flow rate required.

The Applicant has devised, tested and embodied the present invention to overcome the shortcomings of the state of the art and to obtain these and other purposes and advantages.

SUMMARY OF THE INVENTION

The present invention is set forth and characterized in the independent claim. The dependent claims describe other characteristics of the present invention or variants to the main inventive idea.

In accordance with the above purposes, a method is provided to control a secondary cooling apparatus in a machine for continuous casting of metal products in relation to the punctual cooling needs of the metal product.

The secondary cooling apparatus comprises a roller path which supports and moves a cast metal product along an axis of movement, and a plurality of cooling units equipped with nozzles.

Each nozzle is provided with at least two delivery orifices from which a refrigerant fluid is delivered toward the metal product.

In order to cool the metal product, the method provides to activate the delivery orifices individually, in sequence or in combination with each other, so that as the punctual cooling needs of the metal product vary, the correct flow rate of the refrigerant fluid is delivered from one or more of the delivery orifices so as to control the energy consumption of the secondary cooling apparatus, while the latter maintains its function over time, adapting to the punctual cooling needs of the metal product.

This method is simple to manage and also allows a high flexibility in the control of the nozzles according to the punctual needs of the cast metal product in transit.

On each occasion, each nozzle is adjusted by activating one or more of the delivery orifices in a punctual manner, according to the needs of the zone of the metal product to be cooled.

This solution guarantees an extreme flexibility in the control of the secondary cooling of the cast metal product, the cooling being correlated to the punctual needs of the product in transit. This can be achieved thanks to the control, in a punctual and precise manner, of the feed of the individual delivery orifices of the nozzle.

Each nozzle can therefore be connected autonomously to the respective source of refrigerant fluid, in relation to how it is provided and how it has to operate, each nozzle having the individual delivery orifices that can be activated according to punctual needs.

According to a variant, the nozzles that operate on the same cross section of the metal product are fed by a single source.

According to another variant, multiple sources of refrigerant fluid can also be provided.

It is provided that the individual cooling units can also be controlled independently of each other, or they can be controlled in the same manner.

According to the invention, it is also possible to feed one or more specific nozzles with two different refrigerant fluids, for example with air or water, or by mixing the fluids to obtain a single refrigerant mixture.

According to a variant, it is also possible to feed one or more specific nozzles with a pulsating feed. In the case of two or more nozzles controlled with a pulsating feed, one or more specific nozzles fed at constant pressure may or may not be present.

BRIEF DESCRIPTION OF THE DRAWINGS

These and other aspects, characteristics and advantages of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
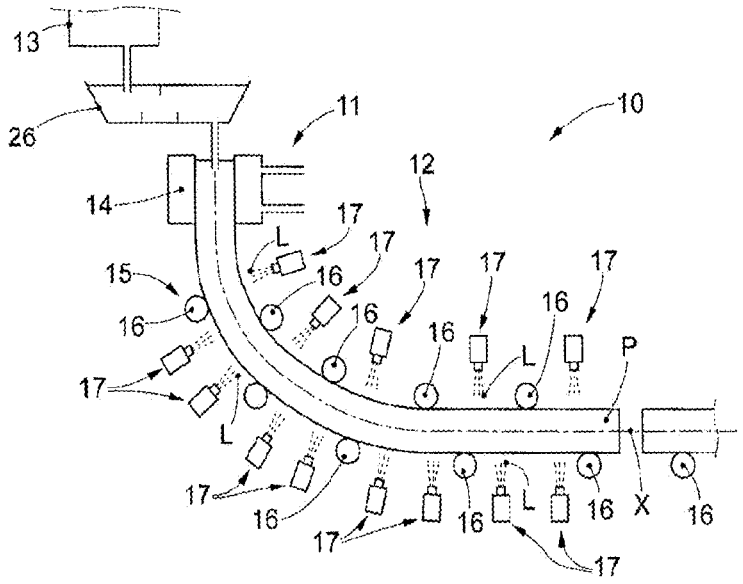
FIG. 1 schematically shows a continuous casting machine of metal products.

We will now refer in detail to the various embodiments of the present invention, of which one or more examples are shown in the attached drawings. Each example is supplied by way of illustration of the invention and shall not be understood as a limitation thereof. For example, one or more characteristics shown or described insomuch as they are part of one embodiment can be varied or adopted on, or in association with, other embodiments to produce other embodiments. It is understood that the present invention shall include all such possible modifications and variants.

Before describing these embodiments, we must also clarify that the present description is not limited in its application to details of the construction and disposition of the components as described in the following description using the attached drawings. The present description can provide other embodiments and can be obtained or executed in various other ways. We must also clarify that the phraseology and terminology used here is for the purposes of description only, and cannot be considered as limitative.

Embodiments described with reference to FIG. 1 concern a machine for the continuous casting of metal products, identified as a whole with reference number 10. The machine 10 is configured to continuously cast metal products P for example in the form of blooms, billets or slabs, or other forms known in the sector.

During the casting process, the metal products P are cooled first by means of a primary cooling apparatus 11, and then by means of a secondary cooling apparatus 12 managed in accordance with the control method according to the present invention.

The machine 10 comprises a tundish 26, able to receive the liquid metal contained in a ladle 13, and a mold, or crystallizer, 14 which the liquid metal passes through.

The primary cooling apparatus 11 is directly associated, in a known manner, with the crystallizer 14 while the secondary cooling apparatus 12 is disposed downstream of the crystallizer 14.

The secondary cooling apparatus 12 comprises a roller path 15 configured both to guide and contain the metal product P exiting the crystallizer 14 and also to remove the heat from the metal product P, for example by radiation and conduction.

The roller path 15 is able to support and move the cast metal product P along an axis of movement X which can be curved, straight or partly curved and partly straight.

The roller path 15 can comprise a plurality of rollers 16 which can be disposed suitably distanced from each other and with the axes of rotation parallel to each other and orthogonal to the axis of movement X. The rollers 16 are configured to guide the metal product P along the casting line up to the extraction zone.

For this purpose, the axes of rotation of the rollers 16 located above the metal product P can lie on a lying plane parallel and distanced with respect to the lying plane on which lie the axes of rotation of the rollers 16 located below the metal product P. In this way, the rollers 16 define a passage and drawing channel in which the cast metal product is advanced.

In possible embodiments, the rollers 16 can also be disposed laterally to the product P, so as to also guide it along the sides.

The secondary cooling apparatus 12 can comprise a plurality of cooling assemblies G disposed in sequence with respect to each other along the continuous casting machine 10.

Figure 2:
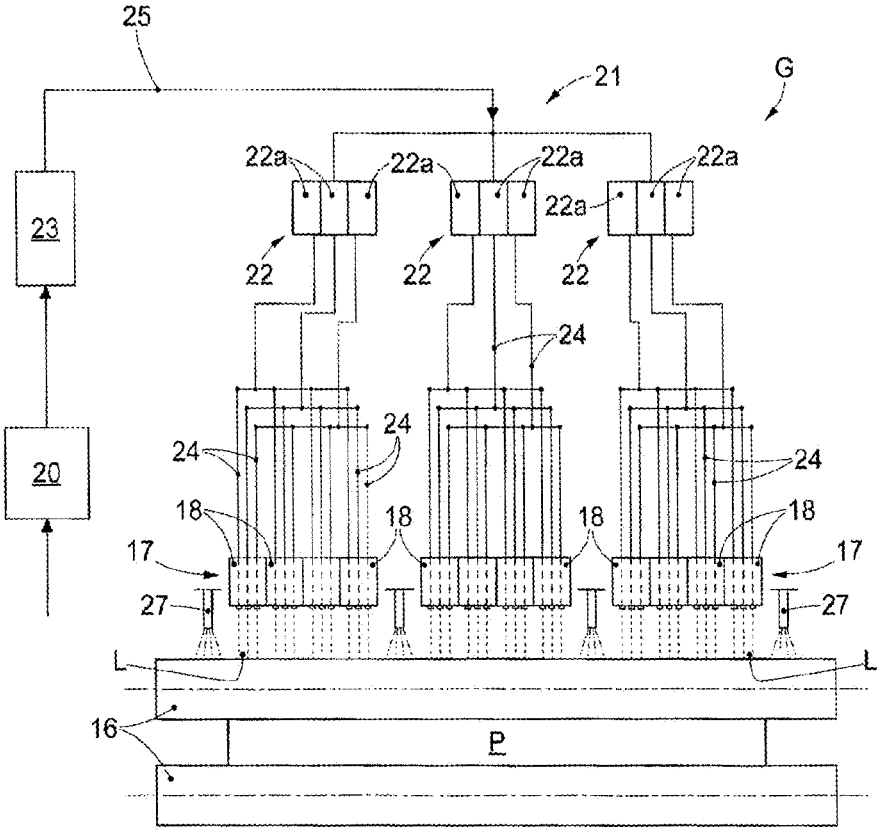
FIG. 2 schematically shows the fluid dynamic connection with which the nozzles of the cooling units are fed, in accordance with embodiments described here.

Each cooling assembly G can comprise a plurality of cooling units 17, each provided with one or more nozzles 18 disposed along the axis of movement X. With particular reference to FIG. 2, the cooling assembly G comprises three cooling units 17.

The cooling units 17 are adjacent to each other to cover a width at least equal to the maximum width of the metal product P that can be cast into the machine 10.

Each cooling unit 17 is able to deliver a determinate flow rate of at least one refrigerant fluid L onto a specific zone of the metal product P.

The cooling units 17 can be associated with the roller path 15 cooperating with the latter to cool the metal product P in transit. In particular, the nozzles 18 can be disposed between the rollers 16, both between those located above the metal product P and also between those located below it, and possibly between those located laterally. In this way, it is possible to direct the refrigerant fluid L toward the metal product P without obstacles and onto the entire metal product P.

According to some embodiments, the cooling units 17 can be disposed both along the vertical segment and also along the curved segment, and possibly, although rarely, on the horizontal segment of the casting line and can act both on the bottom and also on the top of the metal product P. Optionally, the cooling units 17 can also act laterally with respect to the metal product P.

The cooling units 17 can determine the same cooling profile for the upper and lower surface of the metal product P due to the desired cooling curve, or they can determine different and independent cooling profiles.

According to some embodiments, each one of the nozzles 18 of each cooling unit 17 comprises two or more delivery orifices 19 for delivering the refrigerant fluid L onto the metal product P to be cooled.

According to some embodiments, each one of the nozzles 18, preferably present in a number from two to seven for each cooling unit 17, comprises two or more delivery orifices 19, in particular at least two (FIGS. 5*a*-5*d*), for delivering the refrigerant fluid L onto the metal product P to be cooled.

Figure 6:
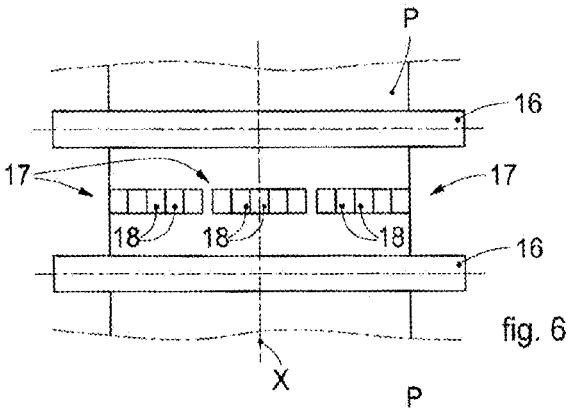
FIGS. 6-8 show possible dispositions of the cooling units and therefore of the nozzles with respect to the metal product to be cooled and/or with respect to the roller path.
Figure 7:
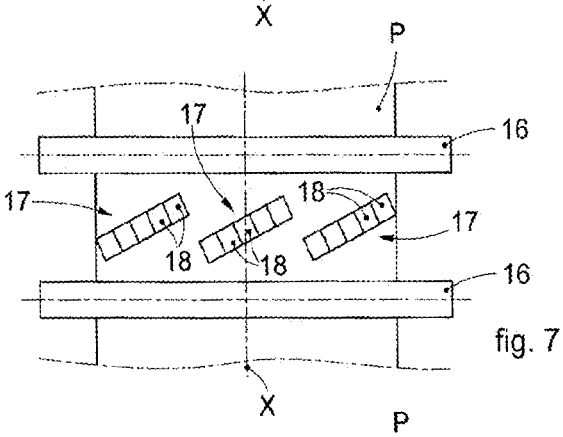
Figure 8:
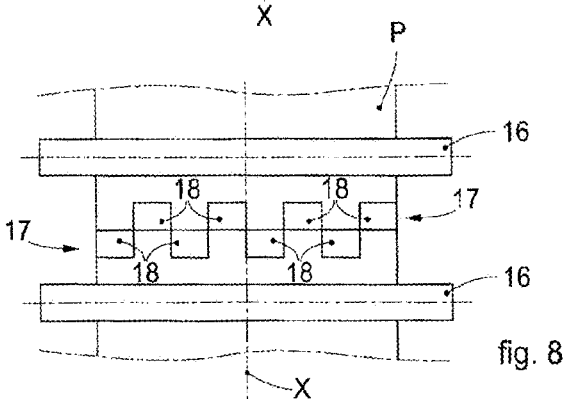

The nozzles 18 can be distributed in a suitable manner both in the direction of the axis of movement X, FIG. 1, and also in directions transverse to the axis of movement X, FIGS. 6-8, so as to guarantee the cooling of any zone whatsoever of the metal product P. For this purpose, the cooling units 17 can be suitably disposed both with respect to the metal product P, that is, with respect to the roller path 15, and also with respect to the axis of movement X. For example, the nozzles 18 can be disposed transversely aligned with respect to the metal product P, FIG. 6, that is, with a desired angle, which can also reach about 45°, FIG. 7. In the example embodiment of FIG. 8, the cooling units 17 are disposed parallel to the axes of rotation of the rollers 16, but with the respective nozzles 18 disposed in a staggered configuration along the axis of movement X, describing a staggered or "checkerboard" type configuration.

Figure 5:
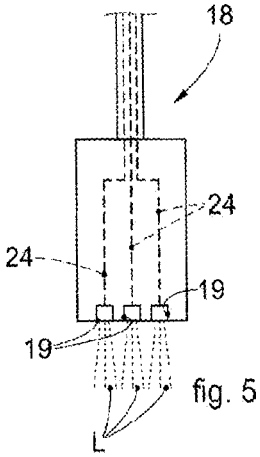
FIG. 5 schematically shows a nozzle in which the delivery orifices are visible.

According to some embodiments, the delivery orifices 19 of a same nozzle 18 are fed independently of each other, by opening or closing one or more connection lines 24 associated with the nozzle 18. For example, it can be provided that a first delivery orifice 19 of one nozzle 18 is associated with a connection line 24 that is different from a second delivery orifice 19 of the same nozzle 18, FIG. 5. Furthermore, with particular reference to FIG. 2, homologous delivery orifices 19 of different nozzles 18 of a same, or also of different, cooling units 17 can be connected to the same connection line 24.

Here and hereafter in the description, with the term "homologous" referred to a delivery orifice 19 we mean that a delivery orifice 19 of one nozzle 18 corresponds by geometric analogy to a delivery orifice 19 of another nozzle 18 of the same cooling unit 17.

Figure 5A:
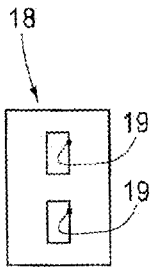
FIGS. 5*a*-5*d* show possible variants of the delivery orifices of FIG. 5.
Figure 5B:
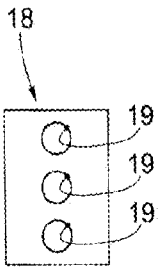
Figure 5C:
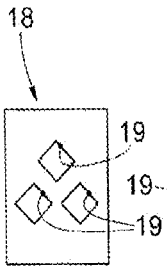
Figure 5D:
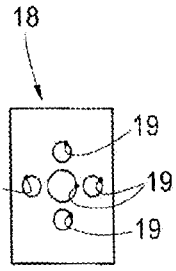

The delivery orifices 19 of the same nozzle 18 can have the same area of the outlet section, FIGS. 5*a*-5*c*, or have different areas of the outlet section, FIG. 5*d*. The shape of the outlet section of each delivery orifice 19 determines the shape of the jet of refrigerant fluid L which can be, for example, blade-shaped or cone-shaped, or other shapes deemed suitable to cool the metal product P.

With reference to FIG. 2, the secondary cooling apparatus 12 also comprises a feed circuit 21 for feeding the cooling units 17. The feed circuit 21 comprises a plurality of valve assemblies 22, wherein each valve assembly 22 can be associated with a respective cooling unit 17. Each valve assembly 22 can comprise at least one valve 22*a* for each of the homologous delivery orifices 19 of different nozzles 18 of the same cooling unit 17.

The feed circuit 21 is connected to at least one feed line 25 configured to fluidically connect means 23 for pumping the refrigerant fluid L to the valve assemblies 22.

Here and hereafter in the description, by feed line 25 we mean the assembly of pipes connected to the pumping means 23, with respect to an initial end thereof, and to the valve assemblies 22, with respect to a terminal end thereof.

Each valve 22*a* can be connected by means of a respective connection line 24 to homologous delivery orifices 19 of the nozzles 18 of the respective cooling unit 17.

The cooling units 17 of a determinate cooling assembly G can be activated independently of each other, since each of them is commanded by a respective valve assembly 22.

Furthermore, each cooling assembly G can be fed autonomously by means of its own feed line 25 which connects the pumping means 23 to the cooling assembly G as above, or two or more of the cooling assemblies G can be fed by the same feed line 25.

Figure 3:
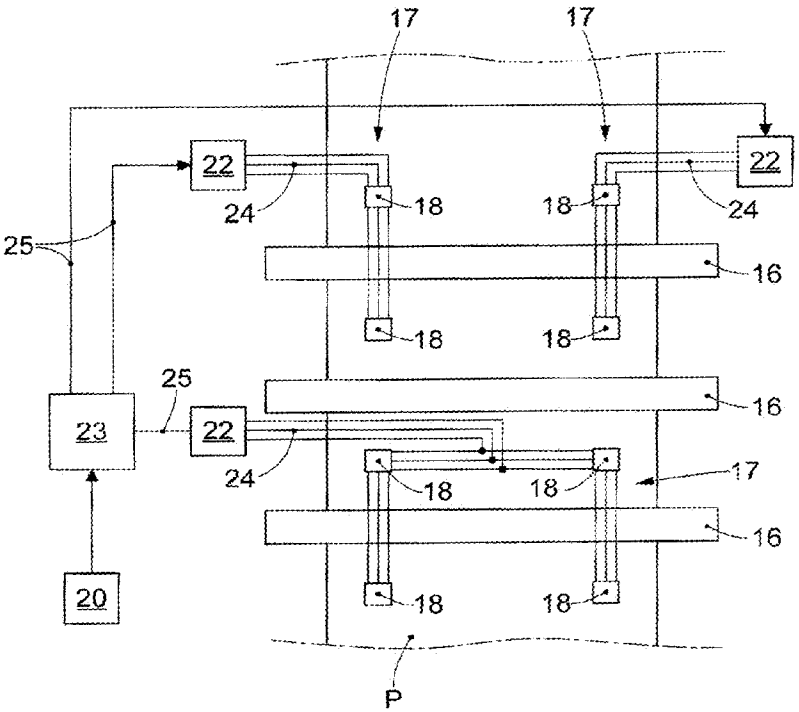
FIG. 3 schematically shows a possible configuration for feeding some cooling units disposed along the horizontal segment of the casting line.

According to some embodiments, schematically shown in FIG. 3, a possible disposition of three cooling units 17 is shown, in which each valve assembly 22 feeds at least two nozzles 18. In this case, in a first cooling unit 17 the valve assemblies 22 define two independent cooling zones, top part of the drawing, while in a second cooling unit 17 the valve assemblies 22 define a single substantially uniform cooling zone, bottom part of the drawing.

Figure 4:
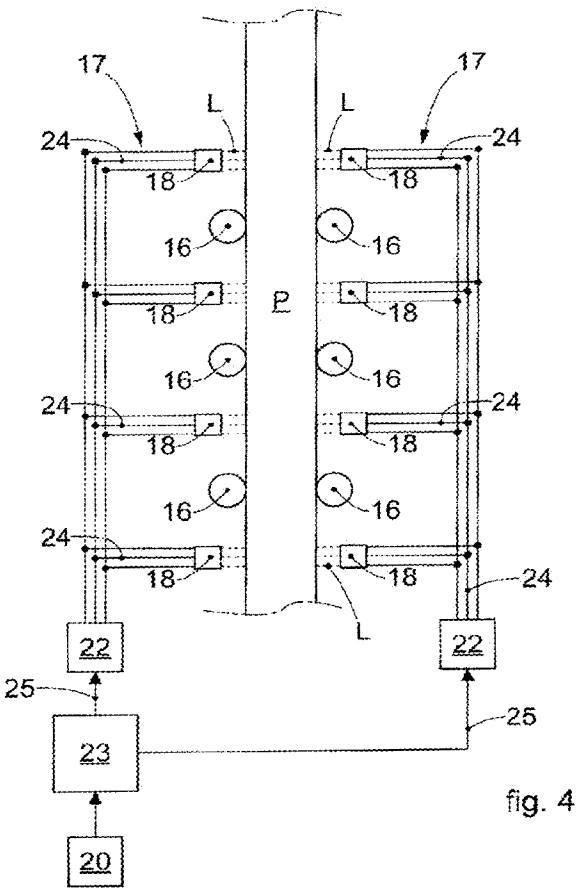
FIG. 4 schematically shows a possible disposition of the cooling units along the vertical segment of the casting line.

According to some embodiments, schematically shown in FIG. 4, the cooling units 17 can also be disposed vertically so as to cool the vertical segment of the metal product P at the exit from the crystallizer 14. Also in this case, each valve assembly 22 can be provided with valves 22*a*, each one connected by means of its own connection line 24 to homologous delivery orifices 19 of the nozzles 18 comprised in said cooling unit 17.

According to some embodiments, the flow rate of refrigerant fluid L and/or the pressure of the flow of refrigerant fluid L which reaches the valve assemblies 22 can be suitably controlled.

According to some embodiments, it is possible to provide a feed line 25 for each valve assembly 22 (parallel feed), or the valve assemblies 22 can be reached by a single feed line 25 (series feed).

According to some embodiments, the cooling of the metal product P can be controlled by surface temperature detectors 27, FIG. 2.

According to possible embodiments, the surface temperature detectors 27 can allow a verification of the punctual temperature.

According to possible embodiments, the surface temperature detectors 27 can allow a feedback control of the flow rate of the refrigerant fluid L. In this case, the surface temperature detectors 27 can detect the temperature of a specific zone of the metal product P and send a respective operating signal to a control and command unit 20 so as to carry out a feedback control in order to define the flow rate values of refrigerant fluid L that the cooling units 17 have to deliver.

According to some embodiments, the flow rates of refrigerant fluid L delivered by the cooling units 17 are controlled by the control and command unit 20 which bases itself on the estimate of the surface temperature with a point-to-point mathematical model. The flow rates of refrigerant fluid L are modified so that the temperature estimated by the mathematical model corresponds with the desired one.

In accordance with some embodiments, the control and command unit 20 can be configured to receive a series of process operating parameters.

The process operating parameters can be chosen in a group comprising the volumetric flow rate of the metal product P, the temperature detected on the metal product P zone by zone, the chemical composition of the metal product P (or steel grade), the format of the product, or other process parameters considered unique.

The control and command unit 20 is also configured to process and send an operating command signal to means 23 for pumping refrigerant fluid L. The operating command signal determines the flow rate Q of refrigerant fluid L required to cool the metal product P According to the embodiments described here, the refrigerant fluid L can be water, possibly treated. However, the use of a refrigerant mixture comprising at least a first liquid refrigerant fluid, for example water, and at least a second aeriform refrigerant fluid, for example air, is not excluded. It is evident that the use of the refrigerant fluid, or mixture, can determine changes to the systems that regulate the pumping of these fluids.

In accordance with some embodiments, a method is provided to control the secondary cooling apparatus 12 described above.

In accordance with one aspect of the present invention, the method provides to activate the delivery orifices 19 individually, in sequence or in combination with each other so that as the punctual cooling needs of the metal product P vary, the flow rate Q of refrigerant fluid L required on each occasion to cool the metal product P varies.

The flow rate Q is defined on the basis of the cooling to be determined on the metal product P, and the energy consumption is minimized by opening the correct and necessary number of delivery orifices 19 which allows to obtain the minimum pressure drop of the feed circuit 21.

The flow rate Q of refrigerant fluid L required can vary both along the axis of movement X, and also in directions transverse with respect to the axis of movement X, according to the specific zone of metal product P to be cooled. The flow rate Q of refrigerant fluid L required can depend, for example, on the chemical composition of the metal material which the metal product P consists of, on the temperature profile possibly detected in a specific zone, for example in a cross section, of the metal product P, on the flow rate of metal product P, and/or other operating parameters.

As the flow rate Q of refrigerant fluid L required to cool the metal product P, or a specific zone thereof, increases or decreases, the delivery orifices 19 of a determinate nozzle 18 are opened, or closed, in sequence, from the first to the last, or from the last to the first, so as to minimize the feed pressure of the refrigerant fluid L to the feed circuit 21. In this way, it is possible to reduce to a minimum the pressure drops reducing, with the same flow rate Q, the power necessary for the pumping means 23 to function.

In accordance with possible embodiments, the method can provide detecting a temperature profile of a determinate zone of the metal product P, sending the temperature values detected to the control and command unit 20, which also receives at least one value of the flow rate of the metal product P. The control and command unit 20 processes the temperature values and the flow rate value and transmits an operating signal to the means 23 for pumping the refrigerant fluid L. The operating signal is the one which allows to deliver the flow rate Q of refrigerant fluid L required to cool the metal product P, operating the selective opening of the delivery orifices 19 to minimize the pressure drops of the feed circuit 21, and therefore to minimize the power necessary for the pumping means 23 to function.

Figure 9:
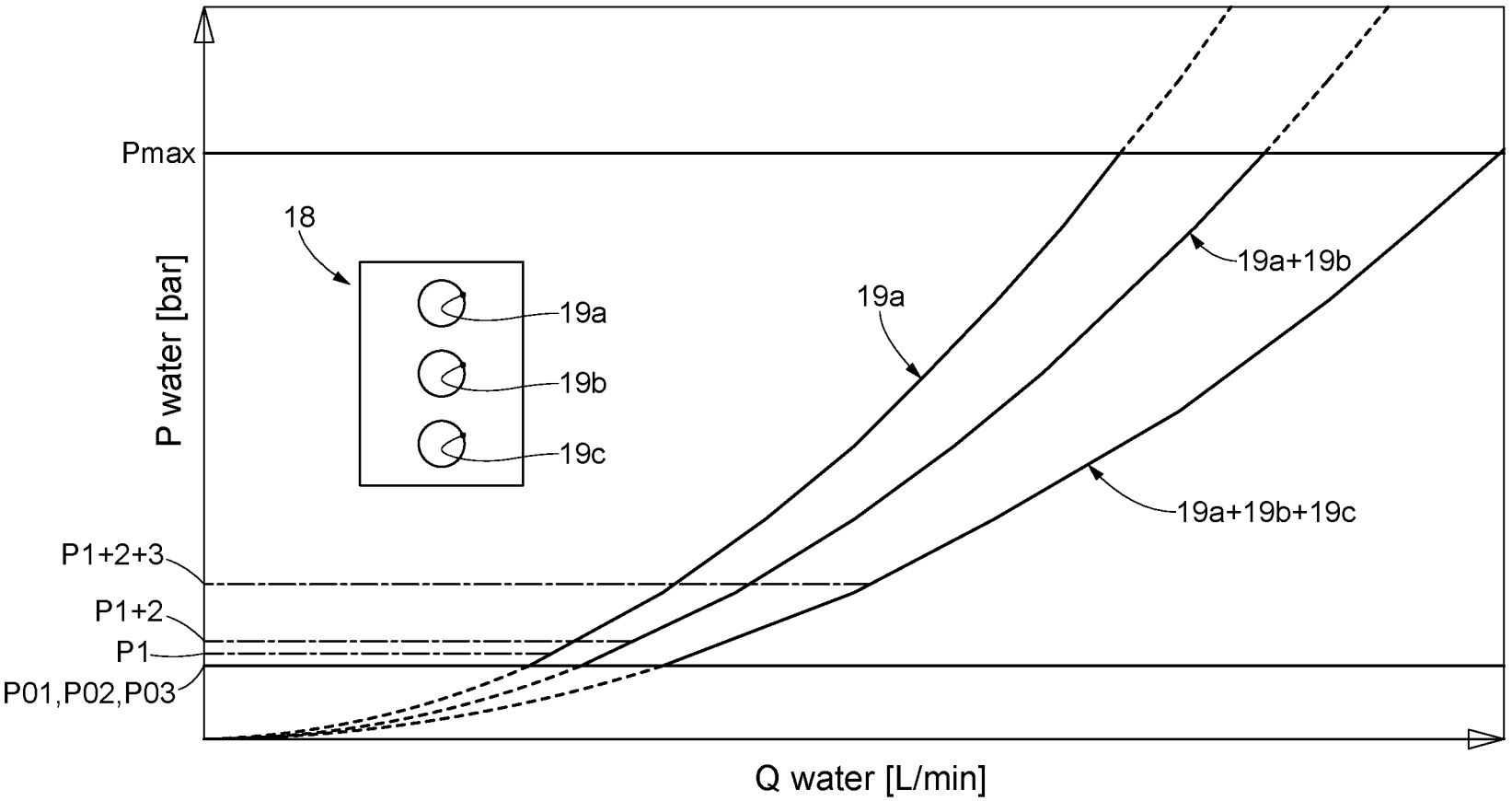
FIG. 9 is a flow rate-pressure graph which shows the functioning and control modes of a nozzle in accordance with the method according to the present invention.

In accordance with an example shown in FIG. 9, the pressure-flow rate curves are shown of a nozzle 18 provided with three delivery orifices 19, in this specific case a first delivery orifice 19*a*, a second delivery orifice 19*b* and a third delivery orifice 19*c*.

When the flow rate Q of refrigerant fluid L required to cool the metal product P, or a specific zone thereof, requires a first feed pressure p1 of the first delivery orifice 19*a* of the nozzle 18 which is lower than a first minimum pressure p01 of the first delivery orifice 19*a*, the entire nozzle 18 is deactivated, that is, it does not deliver the flow rate Q of refrigerant fluid.

When the flow rate Q of refrigerant fluid L required to cool the metal product P requires a first feed pressure p1 of the first delivery orifice 19*a* which is greater than the first minimum pressure p01 of the first delivery orifice 19*a*, and a second feed pressure p1+2 relative to the second delivery orifice 19*b*, associated with the first delivery orifice 19*a*, which is lower than a second minimum pressure p02 relative to the second delivery orifice 19*b* together with the first delivery orifice 19*a*, the first delivery orifice 19*a* is active to deliver the flow rate Q of refrigerant fluid L.

When the flow rate Q of refrigerant fluid L required to cool the metal product P requires a second feed pressure p1+2 which is greater than the second minimum pressure p02, and a third feed pressure p1+2+3, relative to the third delivery orifice 19*c*, associated with the second delivery orifice 19*b* and the first delivery orifice 19*a*, which is lower than a third minimum pressure p03, relative to the third delivery orifice 19*c* together with the second delivery orifice 19*b* and the first delivery orifice 19*a*, the first delivery orifice 19*a* and the second delivery orifice 19*b* deliver overall flow rate Q of refrigerant fluid L.

When the flow rate Q of refrigerant fluid L required to cool the metal product P requires the third feed pressure p1+2+3 which is greater than the third minimum pressure p03, the first delivery orifice 19*a*, the second delivery orifice 19*b* and the third delivery orifice 19*c* deliver overall the flow rate Q of refrigerant fluid L.

In other embodiments of the control method, the delivery orifices 19*a*, 19*b* and 19*c* can also be activated in a different order and combination from that described above.

The first minimum pressure p01, the second minimum pressure p02 and the third minimum pressure p03 can be the same, as shown in FIG. 9, or different from each other. In particular, the minimum pressure is a critical pressure value below which the flow of refrigerant fluid L inside the nozzle 18 becomes unstable.

The delivery orifices 19 of the nozzle 18 are also characterized by a maximum feed pressure pmax which is generally the maximum one available in the feed circuit of the refrigerant fluid L.

It is evident that this control method can be simply extended to a number of nozzles 18 equal to two, or greater than three.

It is clear that modifications and/or additions of steps may be made to the method to control the secondary cooling apparatus 12 of the machine 10 for the continuous casting of metal products as described heretofore, without departing from the field and scope of the present invention.

It is also clear that, although the present invention has been described with reference to some specific examples, a person of skill in the art shall certainly be able to achieve many other equivalent forms of a method to control a secondary cooling apparatus in a machine for the continuous casting of metal products, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. A method to control a secondary cooling apparatus in a machine for continuous casting of metal products, said secondary cooling apparatus (12) comprising a roller path (15) which moves a cast metal product (P) along an axis of movement (X), a plurality of cooling units (17) equipped with nozzles (18), each nozzle (18) being provided with delivery orifices (19) from which a refrigerant fluid (L) is delivered, on each occasion according to punctual cooling needs, toward said metal product (P), said method comprising:

activating said delivery orifices (19) individually, in sequence or in combination with each other, so that as the punctual cooling needs of said metal product (P) vary, a flow rate (Q) of refrigerant fluid (L) required on each occasion to cool said metal product (P) is varied, opening or closing the delivery orifices (19) of respective nozzles (18) in sequence from a first delivery orifice (19*a*) to a last delivery orifice or from the last delivery orifice to the first delivery orifice (19*a*) when the flow rate (Q) of the refrigerant fluid (L) increases or decreases, feeding said delivery orifices (19) with a minimum delivery pressure to obtain said flow rate (Q), and delivering the flow rate (Q) of refrigerant fluid (L) from the first delivery orifice (19*a*) when the flow rate (Q) of cooling fluid (L) required to cool the metal product (P) requires a first feed pressure (p1) of the first delivery orifice (19*a*) of one or more of said nozzles (18) which is greater than a first minimum pressure (p01) of the first delivery orifice (19*a*) and a second feed pressure (p1+2) relative to a second delivery orifice (19*b*) cooperating with said first delivery orifice (19*a*) is lower than a second minimum pressure (p02) relative to said second delivery orifice (19*b*) together with said first delivery orifice (19*a*).

2. The method as in claim 1, further comprising:

deactivating the delivery of refrigerant fluid (L) from at least one of said nozzles (18) when the flow rate (Q) of refrigerant fluid (L) required to cool the metal product (P), or a specific zone thereof, requires a first feed pressure (p1) of the first delivery orifice (19*a*) of one or more of said nozzles (18) which is lower than the first minimum pressure (p01) of said first delivery orifice (19*a*).

3. The method as in claim 2, wherein said first minimum pressure (p01) and said second minimum pressure (p02) are the same.

4. The method as in claim 2, wherein said first minimum pressure (p01) and said second minimum pressure (p02) are different.

5. A secondary cooling apparatus (12) for a continuous casting machine, the secondary cooling apparatus (12) comprising a roller path (15) which moves a cast metal product (P) along an axis of movement (X), a plurality of cooling units (17) equipped with nozzles (18), each nozzle (18) being provided with delivery orifices (19) from which a refrigerant fluid (L) is delivered, on each occasion according to punctual cooling needs, toward said metal product (P), comprising a control and command unit (20) configured to put into practice the method as in claim 2.

6. The method as in claim 1, wherein said first minimum pressure (p01) and said second minimum pressure (p02) are the same.

7. A secondary cooling apparatus (12) for a continuous casting machine, the secondary cooling apparatus (12) comprising a roller path (15) which moves a cast metal product (P) along an axis of movement (X), a plurality of cooling units (17) equipped with nozzles (18), each nozzle (18) being provided with delivery orifices (19) from which a refrigerant fluid (L) is delivered, on each occasion according to punctual cooling needs, toward said metal product (P), comprising a control and command unit (20) configured to put into practice the method as in claim 6.

8. The method as in claim 1, wherein said first minimum pressure (p01) and said second minimum pressure (p02) are different.

9. A secondary cooling apparatus (12) for a continuous casting machine, the secondary cooling apparatus (12) comprising a roller path (15) which moves a cast metal product (P) along an axis of movement (X), a plurality of cooling units (17) equipped with nozzles (18), each nozzle (18) being provided with delivery orifices (19) from which a refrigerant fluid (L) is delivered, on each occasion according to punctual cooling needs, toward said metal product (P), comprising a control and command unit (20) configured to put into practice the method as in claim 8.

10. A secondary cooling apparatus (12) for a continuous casting machine, the secondary cooling apparatus (12) comprising a roller path (15) which moves a cast metal product (P) along an axis of movement (X), a plurality of cooling units (17) equipped with nozzles (18), each nozzle (18) being provided with delivery orifices (19) from which a refrigerant fluid (L) is delivered, on each occasion according to punctual cooling needs, toward said metal product (P), comprising a control and command unit (20) configured to put into practice the method as in claim 1.

11. A method to control a secondary cooling apparatus in a machine for continuous casting of metal products, said secondary cooling apparatus (12) comprising a roller path (15) which moves a cast metal product (P) along an axis of movement (X), a plurality of cooling units (17) equipped with nozzles (18), each nozzle (18) being provided with delivery orifices (19) from which a refrigerant fluid (L) is delivered, on each occasion according to punctual cooling needs, toward said metal product (P), said method comprising:

activating said delivery orifices (19) individually, in sequence or in combination with each other, so that as the punctual cooling needs of said metal product (P) vary, a flow rate (Q) of refrigerant fluid (L) required on each occasion to cool said metal product (P) is varied, opening or closing the delivery orifices (19) of respective nozzles (18) in sequence from a first delivery orifice (19*a*) to a last delivery orifice or from the last delivery orifice to the first delivery orifice (19*a*) when the flow rate (Q) of the refrigerant fluid (L) increases or decreases, feeding said delivery orifices (19) with a minimum delivery pressure to obtain said flow rate (Q), and delivering the flow rate (Q) of refrigerant fluid (L) from the first delivery orifice (19*a*) and a second delivery orifice (19*b*) when the flow rate (Q) of refrigerant fluid (L) required to cool the metal product (P) requires a second feed pressure (p1+2) relative to a second delivery orifice (19*b*) cooperating with a first delivery orifice (19*a*) which is greater than a second minimum pressure (p02), relative to said second delivery orifice (19*b*) together with said first delivery orifice (19*a*).

12. The method as in claim 11, wherein a first minimum pressure (p01) of the first delivery orifice (19*a*) and said second minimum pressure (p02) are the same.

13. A secondary cooling apparatus (12) for a continuous casting machine, the secondary cooling apparatus (12) comprising a roller path (15) which moves a cast metal product (P) along an axis of movement (X), a plurality of cooling units (17) equipped with nozzles (18), each nozzle (18) being provided with delivery orifices (19) from which a refrigerant fluid (L) is delivered, on each occasion according to punctual cooling needs, toward said metal product (P), comprising a control and command unit (20) configured to put into practice the method as in claim 12.

14. The method as in claim 11, wherein a first minimum pressure (p01) of the first delivery orifice (19*a*) and said second minimum pressure (p02) are different.

15. A secondary cooling apparatus (12) for a continuous casting machine, the secondary cooling apparatus (12) comprising a roller path (15) which moves a cast metal product (P) along an axis of movement (X), a plurality of cooling units (17) equipped with nozzles (18), each nozzle (18) being provided with delivery orifices (19) from which a refrigerant fluid (L) is delivered, on each occasion according to punctual cooling needs, toward said metal product (P), comprising a control and command unit (20) configured to put into practice the method as in claim 14.

16. The method as in claim 11, further comprising:

deactivating the delivery of refrigerant fluid (L) from at least one of said nozzles (18) when the flow rate (Q) of refrigerant fluid (L) required to cool the metal product (P), or a specific zone thereof, requires a first feed pressure (p1) of the first delivery orifice (19*a*) of one or more of said nozzles (18) which is lower than a first minimum pressure (p01) of said first delivery orifice (19*a*).

17. The method as in claim 16, wherein said first minimum pressure (p01) and said second minimum pressure (p02) are the same.

18. The method as in claim 16, wherein said first minimum pressure (p01) and said second minimum pressure (p02) are different.

19. A secondary cooling apparatus (12) for a continuous casting machine, the secondary cooling apparatus (12) comprising a roller path (15) which moves a cast metal product (P) along an axis of movement (X), a plurality of cooling units (17) equipped with nozzles (18), each nozzle (18) being provided with delivery orifices (19) from which a refrigerant fluid (L) is delivered, on each occasion according to punctual cooling needs, toward said metal product (P), comprising a control and command unit (20) configured to put into practice the method as in claim 16.

20. A secondary cooling apparatus (12) for a continuous casting machine, the secondary cooling apparatus (12) comprising a roller path (15) which moves a cast metal product (P) along an axis of movement (X), a plurality of cooling units (17) equipped with nozzles (18), each nozzle (18) being provided with delivery orifices (19) from which a refrigerant fluid (L) is delivered, on each occasion according to punctual cooling needs, toward said metal product (P), comprising a control and command unit (20) configured to put into practice the method as in claim 11.

* * * * *